US006772745B2

(12) United States Patent
McEachen et al.

(10) Patent No.: US 6,772,745 B2
(45) Date of Patent: Aug. 10, 2004

(54) BALL LAUNCHING ACTIVITY DEVICE

(75) Inventors: Peter Colin McEachen, Macedonia, OH (US); Michael Miroewski, Aurora, OH (US); Stewart Lenox, Wadsworth, OH (US); Bryan Keller, Hudson, OH (US)

(73) Assignee: The Little Tikes Company, Hudson, OH (US)

( * ) Notice: Subject to any disclaimer, the term of this patent is extended or adjusted under 35 U.S.C. 154(b) by 104 days.

(21) Appl. No.: 10/123,761

(22) Filed: Apr. 16, 2002

(65) Prior Publication Data

US 2003/0195049 A1 Oct. 16, 2003

(51) Int. Cl.[7] ..... F41B 3/04
(52) U.S. Cl. ..... 124/6; 124/51.1; 473/451
(58) Field of Search ..... 124/6, 7, 41.1, 124/45, 51.1, 78; 473/451, 459, 496, 511

(56) References Cited

U.S. PATENT DOCUMENTS

| | | | | | |
|---|---|---|---|---|---|
| 2,129,489 | A | | 9/1938 | Brown | |
| 2,918,915 | A | | 12/1959 | Doeg | |
| 3,108,808 | A | | 10/1963 | Peterson | |
| 3,350,097 | A | | 10/1967 | Chevrette et al. | |
| 3,844,267 | A | * | 10/1974 | Mohr | 124/78 |
| 4,094,294 | A | * | 6/1978 | Speer | 124/56 |
| 4,220,130 | A | | 9/1980 | Glover et al. | |
| 4,515,373 | A | | 5/1985 | Hirshfeld | |
| 4,552,120 | A | | 11/1985 | Nall et al. | |
| 4,596,230 | A | * | 6/1986 | Griffith | 124/78 |
| 4,834,060 | A | | 5/1989 | Greene | |
| 4,961,580 | A | | 10/1990 | Yoe et al. | |
| 5,282,455 | A | * | 2/1994 | Adamson et al. | 124/59 |
| 5,342,064 | A | | 8/1994 | Williamson et al. | |
| 5,464,208 | A | | 11/1995 | Pierce | |
| 5,632,490 | A | | 5/1997 | Brown | |
| 5,857,451 | A | | 1/1999 | Ciluffo et al. | |
| 6,190,271 | B1 | | 2/2001 | Rappaport et al. | |
| 6,305,366 | B1 | * | 10/2001 | Rizzo et al. | 124/6 |

* cited by examiner

*Primary Examiner*—Kien Nguyen
(74) *Attorney, Agent, or Firm*—Renner, Otto, Boisselle & Sklar, LLP

(57) ABSTRACT

A compact ball launching activity device has an upper and lower member. The upper member having multiple funnel shaped openings that are positioned on the sides of the upper member. The upper member also has one funnel shaped opening positioned at the top of the upper member. The device includes a launch system having an angled feeder tray and flywheel. The balls enter the side funnels of the upper member and are collected on the angled feeder tray. The balls fall through a hole in the feeder tray to a launch channel. The flywheel propels the balls through the launch channel, up and out of the funnel positioned at the top of the ball launching activity device.

16 Claims, 5 Drawing Sheets

BALL LAUNCHING ACTIVITY DEVICE

FIELD OF THE INVENTION

This invention relates generally to a children's toy, and, more particularly to, a multiple entry ball collection and launching activity device.

BACKGROUND OF THE INVENTION

Various amusement devices that allow children to collect balls or to collect and reinsert balls into a device are known in the art. For example, it is know to provide a ball collection game where balls are blown upward from an apparatus and collected by a basket or other hand held device. Since the balls are air blown, they are typically small and light in weight. The user typically stands next to the apparatus so that he may collect the balls with the hand held device as they are blown from the bottom of the apparatus. If a ball is not collected, it will drop back into the apparatus. The apparatus continues to blow the balls until the user collects all of the balls.

It is also known to provide a ball collection game where the user attempts to shoot balls into a cylindrical opening. Once the ball is correctly inserted through the opening, it travels through the device and is released at the bottom of the device so that the user may continuously shoot the ball towards the opening.

It is also know to launch balls from a machine in an athletic environment. Athletic ball launching machines are well known in the art. Ball launching machines are used to assist the development of motor skills, such as hand-eye coordination, as well as to practice various athletic skills. For example, a tennis ball launching machine duplicates various shots, such as a lob or a line drive wherein the user practices his shot by returning the various shots towards the tennis ball launching machine. A baseball launching machine duplicates line drives, pop ups and grounders wherein the user may practice fielding the baseballs from the baseball launching machine. Thus, both the tennis ball launcher and the baseball launcher simulate various environments that enable the user to develop various athletic skills.

The prior art ball launching apparatuses, however, do not provide children with the opportunity to collect balls that are launched away from the top of the apparatus and to insert the collected balls back into the apparatus.

Thus, it is desirable to create an improved ball collection and launching apparatus that enables children to develop motor skills as well as burn energy.

Accordingly, it is an object of the invention to provide a ball collection and launching apparatus that randomly shoots balls out of the top of the device at various heights and speeds.

It is another object of the invention to provide a ball collection and launching apparatus that may be simultaneously used by a number of children.

It is another object of the invention to provide a ball collection and launching apparatus that may be used indoors as well as outdoors.

These and other objects of the present invention, as well as the advantages thereof over existing prior art forms, which will become apparent from the description to follow, are accomplished by the improvements herein after described and claimed.

SUMMARY OF THE INVENTION

The present invention is directed to a ball launching activity device having multiple funnel shaped openings positioned on the sides of the device for receiving balls and one funnel shaped opening positioned at the top of the device for discharging balls. The device houses a ball feeder assembly having an angled feeder tray. The balls enter the funnel shaped openings and are collected on the angled feeder tray. The balls fall through a hole in the angled feeder tray into a launch channel. A flywheel propels the balls through the launch channel, up and out of the funnel shaped opening positioned at the top of the device.

The following detailed description of embodiments of the invention, taken in conjunction with the appended claims and accompanying drawings, provide a more complete understanding of the nature and scope of the invention.

DETAILED DESCRIPTION

Figure 1:
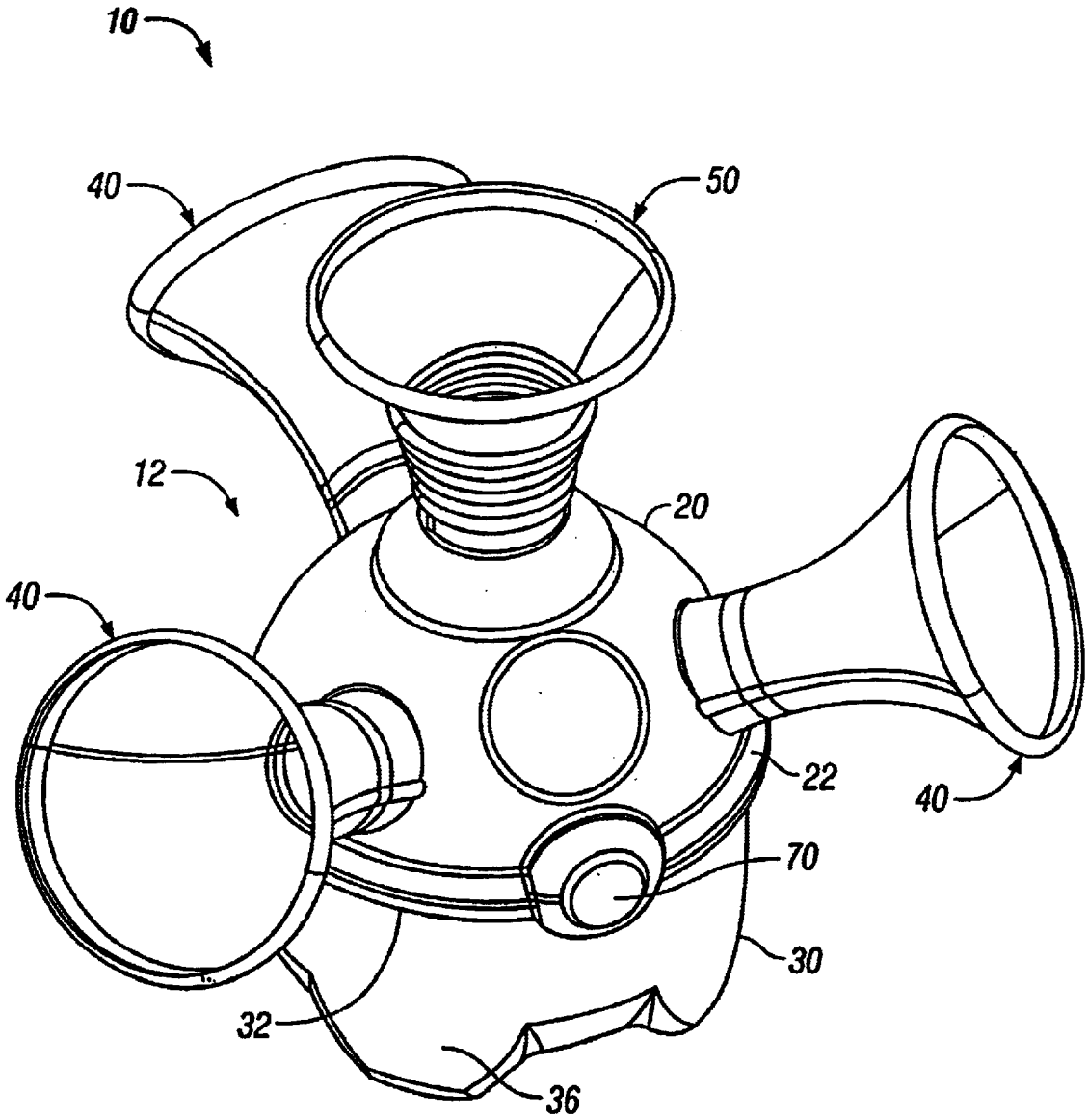
FIG. 1 is a top perspective view of the ball launching activity device of the present invention.

FIG. 1 illustrates the multiple entry ball launching activity device of the present invention, in general at 10. The ball launching device includes a housing 12 with funnels 40 and 50 that extend out from the housing 12. The housing 12 includes an upper member 20 and a lower member 30. The upper member 20 is shaped as half of a sphere with an opening at the underside of the half. The upper member 20 forms a ball receiving chamber 14. The upper member 20 also has a border 22 around the bottom outer rim of the upper member 20 with a plurality of integrally formed receptacles 23 (see FIG. 2) adapted to receive a fastener. The lower member 30 is cylindrical in shape with a border 32 around the top outer rim. The border 32 around the lower member 30 includes an upwardly extending projection 33 (see FIG. 3) that abuts the border 22 of the lower member 30 and a plurality of integrally formed holes 34 that align with the receptacles 23 of the upper member 20 to form the housing 12, as illustrated in FIG. 1. A fastener (not shown) is inserted through the underside of each hole 34 in the lower member 30 and into the receptacle 23 of the upper member 20 to secure the members of the housing together.

The lower member 30 also has four foot members 36 that are downwardly extending from the lower member 30. The foot members 36 are positioned an equal distance apart from one another thereby forming a square.

An on/off button 70 is positioned on the outside surface of the housing 12. The on/off button 70 is surrounded by the borders 22 and 32 of the upper member 20 and lower member 30, respectively. The on/off button 70 is coupled to a control circuit 71 (see FIG. 5), and when activated, sends a signal to the control circuit 71.

Figure 2:
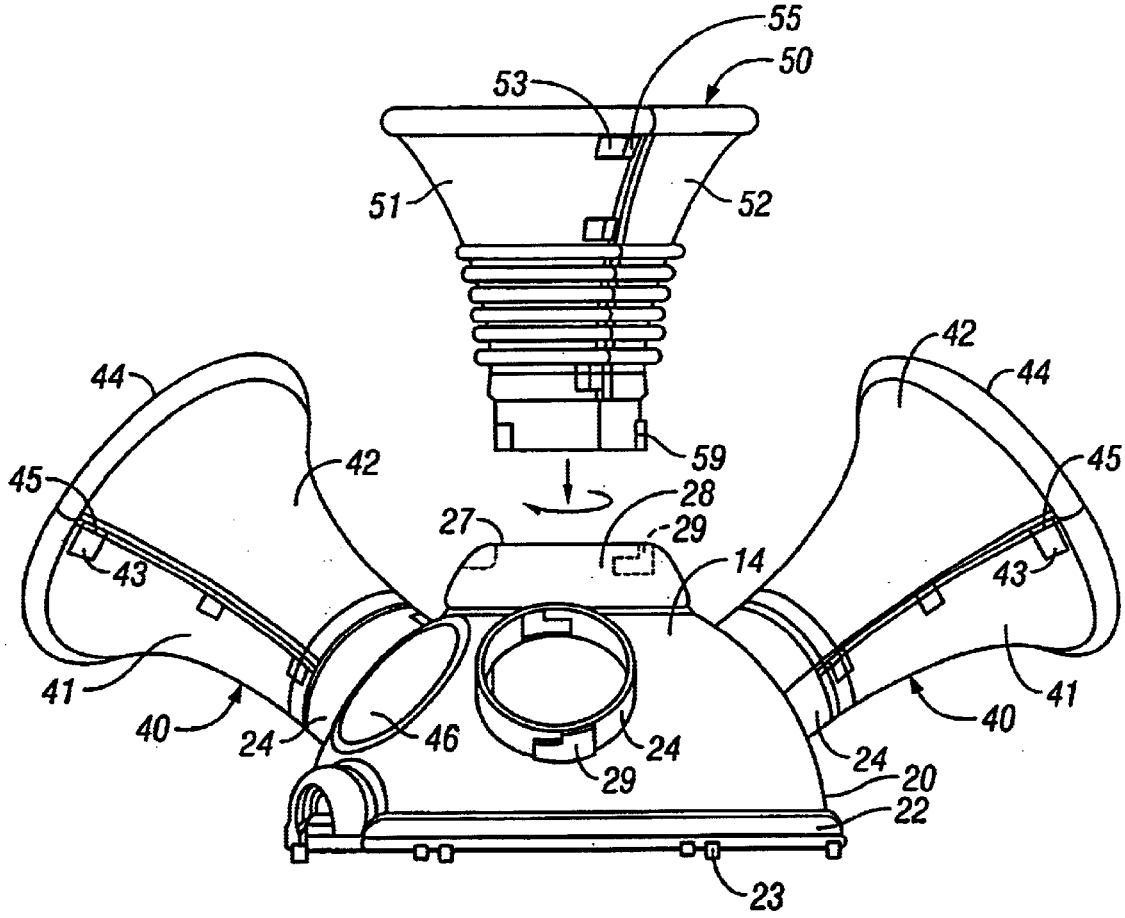
FIG. 2 is a perspective partially exploded view of the upper member of the ball launching activity device of FIG. 1.

Multiple side funnels 40, preferably three, extend from the sides of the upper member 20 of the housing 12. The side funnels 40 are positioned approximately the same distance apart from each other. As shown in FIG. 2, the side funnels 40 are constructed from two sections 41 and 42. One section 41 includes a plurality of small openings 43 while the other section 42 includes a plurality of latches 45. The funnels are formed by aligning the latches 45 to the openings 43 and snapping the sections 41 and 42 together. The two sections 41 and 42 form a funnel with a wide circular opening 44. The diameter of each side funnel 40 narrows from the wide circular opening 44 to a smaller circular opening 46 that mates with the sleeves 24 that extend outwardly from the upper member 20.

An additional funnel extends from the top of the upper member 20 and is surrounded by the side funnels 40. The top funnel 50 is formed from two sections 51 and 52. One section 51 includes a plurality of small openings 53 while the other section 52 includes a plurality of latches 55. The funnel 50 is formed by aligning the latches 55 to the openings 53 and snapping the sections together. The two sections 51 and 52 form a funnel 50 with a wide circular opening 54 which narrows to a smaller circular opening 56.

Figure 6:
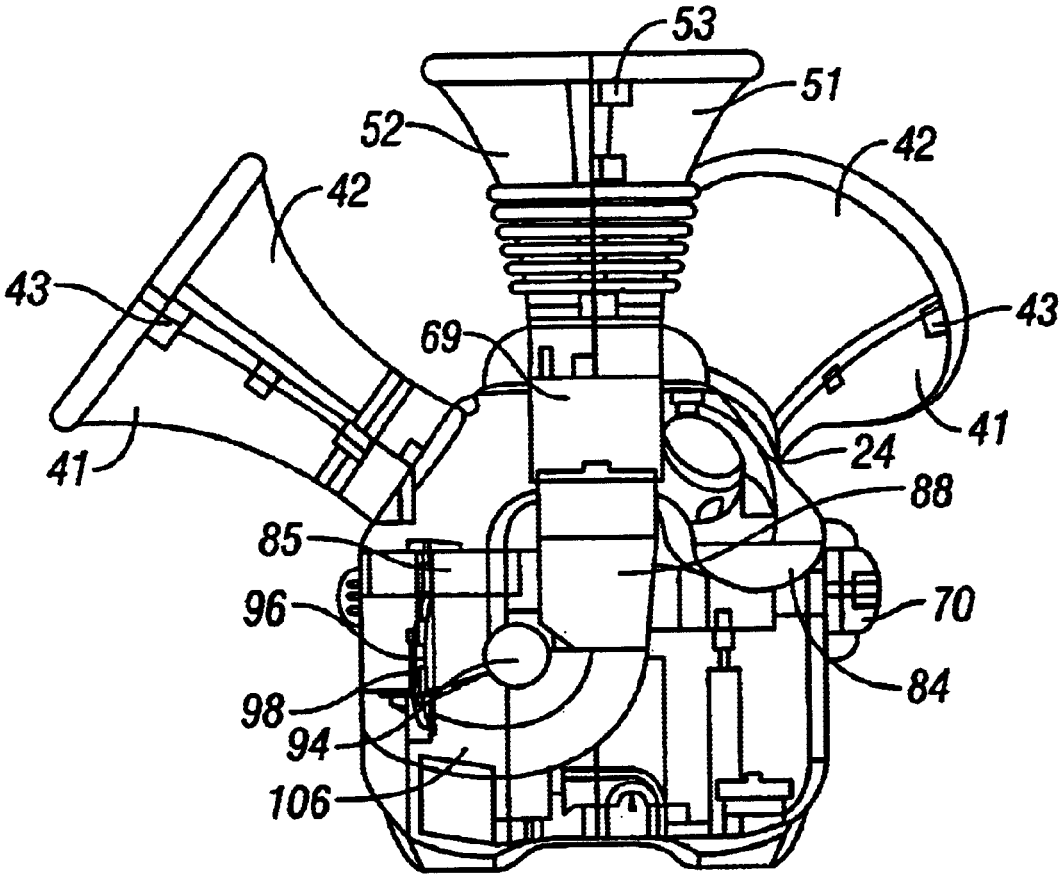
FIG. 6 is a cross sectional view of the ball launching device of the present invention.

The top of the upper member 20 includes a raised dome 28 with a circular opening 27 that is sized to accommodate the top funnel 50. The raised dome 28 includes a downwardly extending cylinder 69 (see FIG. 6) that extends from the top of the circular opening 27 towards the border 22 of the upper member 20. As shown in FIG. 6, the downwardly extending cylinder 69 rests on the top of the launch cylinder 88 thereby forming a passageway for the balls to exit the device.

The raised dome 28 includes a plurality of slots 29, preferably L-shaped, positioned within the inner surface of the raised dome 28. The top funnel 50 includes a plurality of tabs 59 that extend outwardly from the funnel 50. The top funnel 50 is inserted into the circular opening 27 of the raised dome 28 so that the tabs 59 are inserted into slots 29. The funnel 50 is then twisted clockwise, as shown by the arrows in FIG. 2, to secure the top funnel 50 to the raised dome 28.

The upper member 20 also includes three cylindrical sleeves 24 that are sized to accommodate the side funnels 40. The sleeves 24 include at least two slots 29, preferably L-shaped and the funnels 40 include at least two outwardly extending tabs 49. When installed in the upper member 20, the tabs 49 of the side funnels 40 are inserted into the slots 29 in the sleeves 24. The side funnels 40 are then twisted clockwise to secure each side funnel 40 to the sleeve 24.

Figure 3:
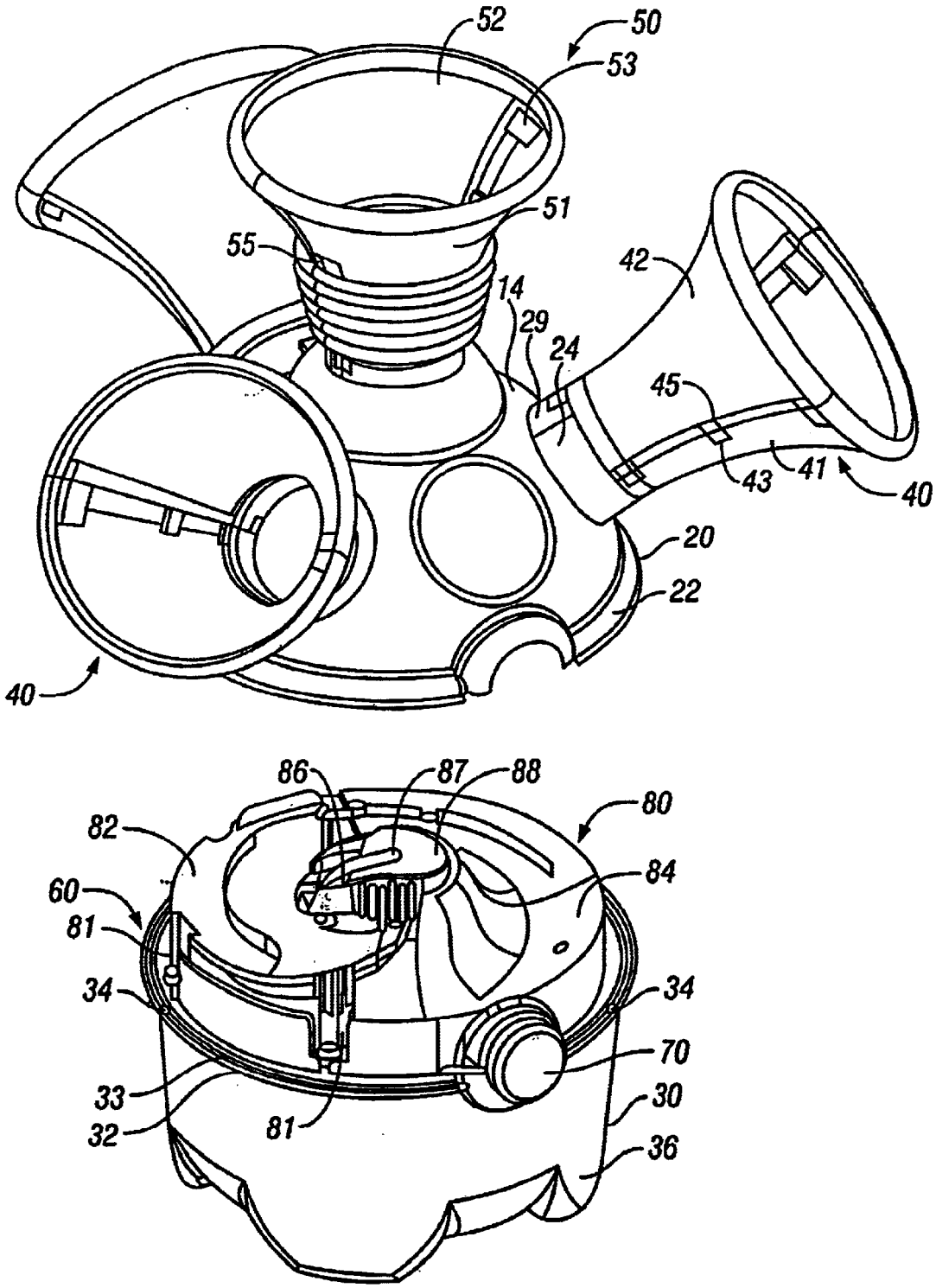
FIG. 3 is a perspective exploded view of the ball launching activity device of FIG. 1 with the upper member detached from the lower member.

FIG. 3 illustrates the upper member 20 of the housing 12 removed from the lower member 30 of the housing 12. The launch system 60 is housed in the lower member 30 of the device. The launch system 60 includes ball feeder assembly 80 and launch assembly 90 (see FIG. 4). The ball feeder assembly 80 covers the launch assembly 90 in the lower member 30. The ball feeder assembly 80 includes a ramp 82, an angled feeder tray 84, and an interface device or stop 86. The ramp 82 includes a plurality of downwardly extending legs 81. The legs 81 support the ramp 82 above the angled feeder tray 84. The ramp 82 spirals downward towards the upper end of the angled feeder tray 84. The angled feeder tray 84 continues to spiral downward toward the launch entry hole 85 that leads to the launch assembly 90. As a result, the ramp 82 extends the spiral path thereby enabling the balls to line up in the chamber 14 of the device. This prevents excess balls from entering the launch assembly potentially damaging the device.

The angled feeder tray 84 also includes a launch cylinder 88 positioned in the center of the angled feeder tray 84. The launch cylinder 88 extends upwards from the angled feeder tray 84 and includes a circumference slightly smaller than that of the downwardly extending cylinder 69 of the upper member 20 (see FIG. 6).

The interface device 86 is pivotally mounted to the angled feeder tray 84 above the launch cylinder 88. The interface device 86 includes a tongue 87 that extends over the opening of the launch cylinder 88. In use, the balls travel upward through the launch cylinder 88 and displace the interface device 86 upwards so that the balls may exit the launch cylinder 88 and travel up and out of the top funnel 50. After the ball travels through the launch cylinder 88, the interface device 86 pivots back to its initial position covering a portion of the opening of the launch cylinder 88. If a ball were to enter the top funnel after being discharged from the device, the interface device 86 would prevent the ball from re-entering the launch system of the ball launching device.

Figure 5:
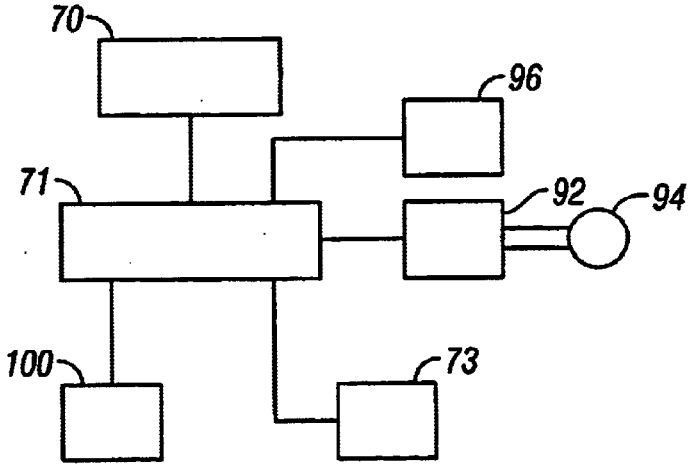
FIG. 5 is a schematic view of the launch assembly in the ball launching activity device of FIG. 1.
Figure 4:
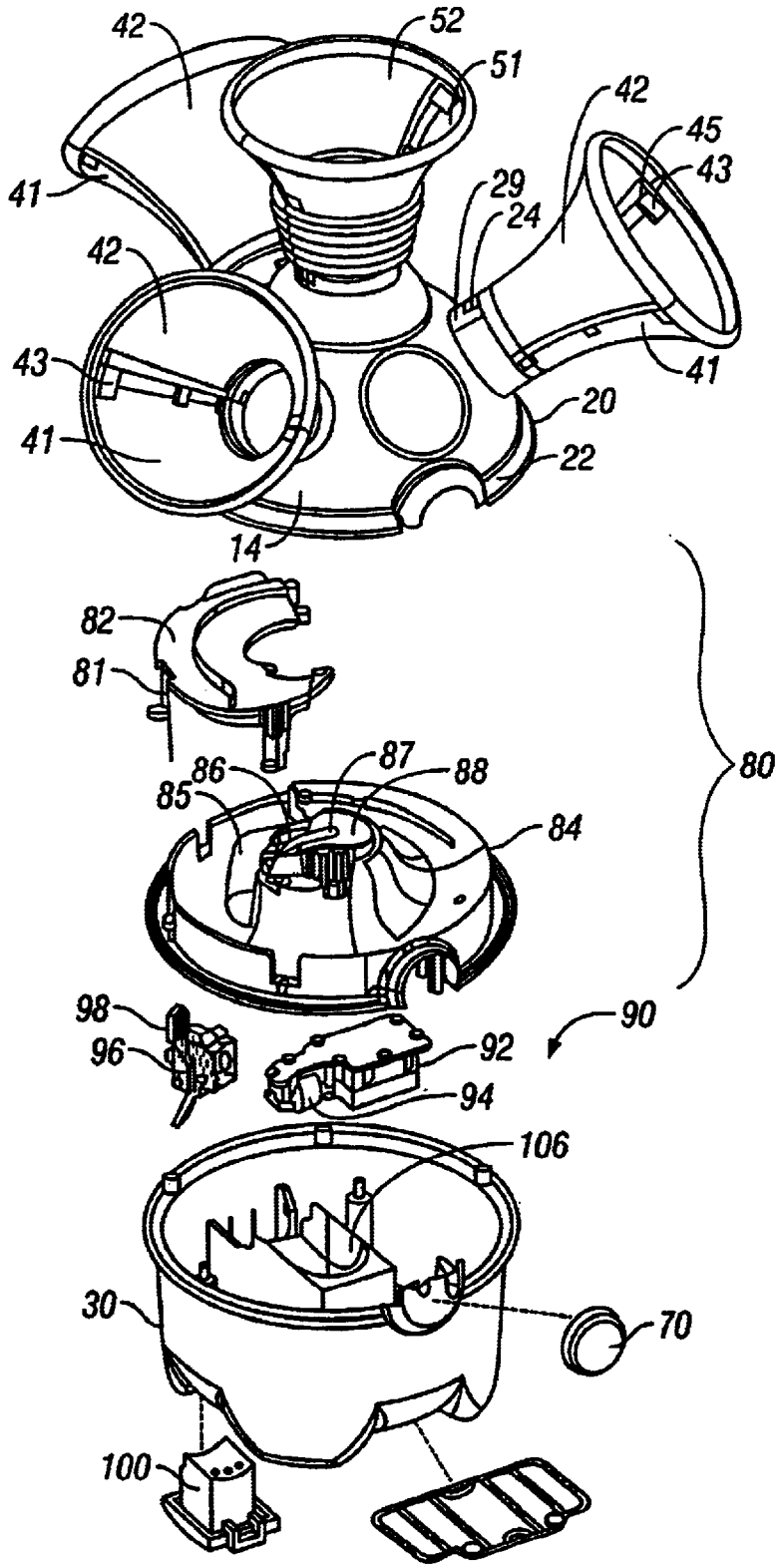
FIG. 4 is a perspective partially exploded view of the ball launching activity device of FIG. 1.

As shown in FIGS. 4–6, the launch assembly 90 includes a motor 92 and a flywheel 94 that are electrically coupled to a control circuit 71. The launch assembly 90 also includes an index ball dropper 96 that is electrically connected to the control circuit 71. The index ball dropper 96 includes a pivotally connected hook member 98 that is biased by a spring. The control circuit 71 activates the pivotally connected hook member 98 of the index ball dropper 96 such that the hook member 98 pivots from an engaged position to a released position thereby controlling the balls as they enter the launch assembly 90 from the launch entry hole 85.

FIG. 5 illustrates a schematic diagram of the motor 92, the flywheel 94 and the index ball dropper coupled to a control circuit 71. The on/off button 70 is the activation switch of the device that is also coupled to the control circuit 71. The control circuit 71 is also coupled to a battery 100 and a speaker 73.

When the user depresses or activates the button 70, the control circuit 71 in the lower member 30 is activated. The control circuit 71 starts motor 92 and activates the speaker 73, or other audio device. The speaker 73 releases a sound that signifies the device is in the "on" mode. The motor 92 is coupled to the flywheel 94 such that the flywheel 94 is capable of spinning at various speeds.

A launch channel 106 is also positioned in the lower member 30 of the housing 12. As shown in FIG. 6, the launch channel 106 is positioned such that one end of the launch channel 106 is directly under the launch entry hole 85 in the angled feeder tray 84. The opposite end of the launch channel 106 is aligned with the launch cylinder 88 of the angled feeder tray 84.

A battery 100 is located in a compartment in the underside of the lower member 30. As shown in FIG. 5, the battery is coupled to the control circuit and generates the current for the control circuit to activate the device.

To use the ball launching device, a child would activate the device by depressing the button 70 which sends a signal to the control circuit 71 that the device has been activated. The device releases a sound via speaker 73, such as "Ding, Ding, Ding," to signify to the user that the device is on. The control circuit 71 also activates the motor 92 which begins to spin the flywheel 94. Children may insert balls into the side funnels 40. Preferably, the balls are made of foam, but may be made from plastic.

The balls enter the device through the side funnels 40 and enter the ball feeder assembly 80. Depending on the location of the side funnel the ball enters, the ball either lands on the ramp 82 or the angled feeder tray 84. As illustrated in FIG. 6, the upper member 20 of the device is partially hollow. As a result, the balls that are inserted through the side funnels 40 are stored on the spiral ramp 82 and angled feeder tray 84. The balls gradually roll along the spiral path of the ramp 82 and angled feeder tray 84 towards the launch entry hole 85. The balls are stopped by the pivotable hook member 98 of the index ball dropper 96. The control circuit 71 activates the hook member 98 of the index ball dropper 96 to allow the balls to enter the launch channel 106 in a timed sequence thereby preventing the balls from jamming the launch assembly 90. Thus, the balls fall through the launch entry hole 85 in the angled feeder tray 84, one at a time, to the launch channel 106. Once the ball is in the launch channel 106, it is contacted by the spinning flywheel 94. The flywheel 94 propels the ball through the launch channel 106 forcing the ball up the launch cylinder 88 and discharging the ball from the top funnel 50. The flywheel 94 is capable of operating at different speeds. As a result, each ball is randomly launched from the device at various heights. The flywheel 94 is capable of launching the ball to about 10 feet high.

The ball launching process lasts for a number of minutes, preferably between 2 to 5 minutes. Typically, the device signals that the launching is about to begin with a specific sound. Then, the balls are launched out of the device for a period of time, preferably 30 seconds. After the launch period, the device enters a "rest" mode wherein the children may collect the balls that were not caught during the launch period. Also, during the rest mode, the balls remaining in the device, are not fed into the launch channel. This prohibits the balls from getting stuck in the launch assembly. Once the rest mode is complete, the children may insert the collected balls into the side funnels 40 so that the device may launch more balls.

The ball launching device also includes an automatic off function wherein the device is configured to shut off after a predetermined period of inactivity.

Additionally, the device may be designed so that the three side funnels are different colors, for example, green, yellow and blue. The device may also include four balls of each of the different colors. The object of the activity device would be for children to insert each colored ball in the correct colored funnel. The child who correctly inserts their colored balls into the correct funnel first would win the game.

While the preferred embodiment of this invention has been shown and described, it will be apparent to those skilled in the art that changes and modifications may be made therein without departing from the spirit of the invention, the scope of which is defined by the appended claims.

What is claimed is:

1. A compact ball launching activity device for children, the device comprising:

a plurality of openings for receiving balls;

a ball receiving chamber located within the compact ball launching activity device, the chamber continuously coupled to the plurality of openings;

a launch system positioned within the compact ball launching activity device, the launch system having a ball propelling member for propelling the balls out of the ball launching activity device and a tray located below the chamber, wherein the tray is positioned between the chamber and the ball propelling member; and a discharge opening for discharging the balls outside of the device.

2. The device of claim 1, wherein the device has an upper member and a lower member.

3. The device of claim 2, wherein the plurality of openings and the discharge opening extend from the upper member.

4. The device of claim 2, wherein the launch system is positioned in the lower member.

5. The device of claim 1, wherein the tray is angled towards a launch entry hole, whereby the tray collects balls as they enter the device and feeds the balls into the ball propelling member via the launch entry hole.

6. The device of claim 1, wherein the ball propelling member includes a flywheel that is controlled by a motor electrically coupled to the ball launching device.

7. The device of claim 1, wherein the ball launching activity device further includes a channel and a cylinder for guiding the balls when launched from the device.

8. The device of claim 7, wherein one end of the channel is positioned below a launch entry hole in the tray and an opposite end of the channel is positioned below the cylinder.

9. The device of claim 1, wherein the ball receiving chamber is substantially hollow for storing the balls before launching.

10. The device of claim 1, further comprising a ball dropper for controlling the balls as they approach the ball propelling member.

11. The device of claim 1, further comprising a stop attached to the tray, wherein the stop prevents the balls from re-entering the launch system.

12. A compact ball launching activity device for children, the device comprising:

a plurality of openings for receiving balls;

a ball receiving chamber located within the compact ball launching activity device, the chamber coupled to the plurality of openings;

a launch system positioned within the compact ball launching activity device, the launch system having a ball propelling member for propelling the balls out of the ball launching activity device and a tray located below the chamber, wherein the tray is positioned between the chamber and the ball propelling member; and a discharge opening for discharging the balls outside of the device; and wherein the plurality of openings includes a plurality of funnels extending from the device.

13. A compact ball launching activity device for children, the device comprising:

a plurality of openings for receiving balls;

a ball receiving chamber located within the compact ball launching activity device, the chamber coupled to the plurality of openings;

a launch system positioned within the compact ball launching activity device, the launch system having a ball propelling member for propelling the balls out of the ball launching activity device and a tray located below the chamber, wherein the tray is positioned between the chamber and the ball propelling member; and a discharge opening for discharging the balls outside of the device, wherein the discharge opening includes a funnel extending from the top of the device.

14. A compact ball launching activity device for children, the device comprising:

a plurality of openings for receiving balls;

a ball receiving chamber located within the compact ball launching activity device, the chamber coupled to the plurality of openings;

a launch system positioned within the compact ball launching activity device, the launch system having a bail propelling member for propelling the balls out of the ball launching activity device and a tray located below the chamber, wherein the tray is positioned between the chamber and the ball propelling member; and a discharge opening for discharging the balls outside of the device; and wherein the tray provides a spiral path that is adapted to store a plurality of balls.

15. The device of claim 14, further comprising a ramp positioned above the tray for extending the spiral path of which the balls travel.

16. A compact ball launching activity device for children, the device comprising:

a plurality of openings for receiving balls;

a means for collecting and holding the balls within the device, the collecting and holding means coupled to the plurality of openings;

a launch channel;

a means for feeding the balls from the collecting means to the launch channel;

a means for propelling the balls through the launch channel; and a means for discharging the balls from the device,whereby users are able to selectively insert balls into any one of the plurality of openings and the ball are returned via the discharging means.

* * * * *